US006741832B2

(12) United States Patent
Tomatsu

(10) Patent No.: US 6,741,832 B2
(45) Date of Patent: May 25, 2004

(54) THERMAL FIXING DEVICE FOR IMAGE FORMING APPARATUS

(75) Inventor: Yoshiya Tomatsu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 10 days.

(21) Appl. No.: 10/098,471

(22) Filed: Mar. 18, 2002

(65) Prior Publication Data

US 2002/0131801 A1 Sep. 19, 2002

(30) Foreign Application Priority Data

Mar. 16, 2001 (JP) ..... 2001-076920
Mar. 16, 2001 (JP) ..... 2001-076921

(51) Int. Cl.[7] ..... G03G 15/00
(52) U.S. Cl. ..... 399/400
(58) Field of Search ..... 399/328, 329, 399/330, 331, 397, 400; 219/216

(56) References Cited

U.S. PATENT DOCUMENTS 5,303,015 A * 4/1994 Sato ..... 399/69
6,108,514 A * 8/2000 Nakayama et al. ..... 399/400
6,148,159 A * 11/2000 Shiraishi ..... 399/44
6,564,025 B2 * 5/2003 Sameshima et al. .... 399/400 X

FOREIGN PATENT DOCUMENTS

JP 2000-137398 * 5/2000

* cited by examiner

*Primary Examiner*—Hoan Tran
(74) *Attorney, Agent, or Firm*—Oliff & Berridge, PLC

(57) ABSTRACT

A toner image that is formed on a photosensitive drum is transferred onto a paper and the paper is fed between a heat roller and a pressure roller so that the toner is fixed onto the paper. The guide plate for guiding the paper between the heat roller and the pressure roller is arranged so as to contact the paper between a first surface and a second surface. Because the position of the paper is fed stably, the toner is not scattered from the paper and deterioration in the image is prevented.

20 Claims, 10 Drawing Sheets

THERMAL FIXING DEVICE FOR IMAGE FORMING APPARATUS

BACKGROUND OF THE INVENTION

1. Field of Invention

The invention is related to a thermal fixing device applied to a device for forming an image by an electrophotographic method.

2. Description of Related Art

The device for forming an image by the electrophotographic method, such as a laser printer, has a thermal fixing device for fixing toner transferred onto a paper. As shown in FIG. 7, the thermal fixing device 61 has a heat roller 62 operating as a heater and a pressure roller 63 and applies heat and pressure to a paper 64 passing between the rollers 62, 63 to melt and fix the toner on the paper 64.

A guide plate 65 for guiding the paper 63 is arranged in the upstream side of the rollers 62, 63 relating to the paper feeding direction. The paper 64 is guided by the guide plate 65 and enters a nip portion 66 where the rollers 62, 63 are in contact and the paper 64 is fed to the downstream side while being heated and pressed.

As shown in FIG. 8, the peripheral surface of the heat roller 62 is formed in a reversed arch crown shape and the peripheral surface of the pressure roller 63 is formed in an arch crown shape. A stretching force, in the width direction of the paper 64, is applied to the paper 64 when entered into the nip portion 66 and the paper 64 so fed is stretched to avoid creasing.

As shown in FIG. 7, the guide surface 65*a* that is an upper surface of the guide plate 65 is arranged lower than a surface S extending so as to include a tangent common to the rollers 62, 63 at the nip portion 66. The guide surface 65*a* extends almost parallel to the surface S. A front end of the paper 64 is guided by the guide surface 65*a* and the paper 64 enters the nip portion 66, however, the paper 64 does not contact the guide surface 65*a* when the paper 64 is held by the nip portion 66. Because the guide plate 65 is heated to an extent by the heat roller 62, the paper 64 could be preheated when contacting the guide plate 65. However, if the paper 64 does not contact the guide plate 65, the paper 64 is not preheated and the toner cannot be fixed certainly.

If the guide surface 65*a* is arranged closer to the heat roller 62, the paper 64 contacts the guide surface 65*a* and the paper 64 can be preheated. However, the following problems occur if the guide surface 65*a* is arranged too close to the heat roller 62.

At the beginning of the fixing process, the front end of the paper 64 is held by the nip portion 66 and the rear end of the paper 64 is held between a photosensitive drum and a transfer roller. After the paper 64 proceeds and the rear end of the paper 64 is released from the photosensitive drum and the transfer roller, the paper 64 is lifted by the reaction of the release. The toner on the paper 64 that is not fixed contacts the photosensitive drum and the adjacent portions, and the toner is scattered.

SUMMARY OF THE INVENTION

It is an object of the invention to provide a thermal fixing device for guiding the paper smoothly.

The thermal fixing device of the invention comprises a heater, a pressure member arranged in contact with the heater, a feeder for feeding a medium and a guide member for guiding the medium fed by the feeder to a contact portion where the heater and the pressure member contact, wherein the guide member is arranged so as to guide the medium in contact with the medium between a first surface and a second surface, and the first surface is a surface including a line that links the contact portion and the feeder and the second surface is a surface including a second line that is perpendicular to a first line that links a curvature center in the contact portion of the heater and a curvature center in the contact portion of the pressure member at a point where the first line crosses the contact portion.

The heater is a heat roller that is heated by a heat source and the pressure member is an elastic pressure roller. In this case, the first surface is defined as a surface extending so as to contact a pressure roller side surface of the heat roller and a surface of the feeder. The second surface is defined as a surface including a tangent common to two circles including a circle having a shaft center of the heat roller as a center and a circle having a shaft center of the pressure roller as a center.

A film of an endless belt that is heated by a heat source can be used for the heater. Because the film is very thin and its temperature is easy to increase, the time until the start of the image forming can be shortened.

The guide member can be kept in a float condition electrically to prevent the developer on the medium from being scattered. The guide member can be earthed via a rectifying member (for example, a Zener diode).

The guide member can be urged in the direction of the heater by an urging member. The urging member may be structured to rotate the guide member around a shaft.

The width of the guide member is set smaller than the width of the fed medium.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF PREFERRED EMBODIMENTS

Figure 1:
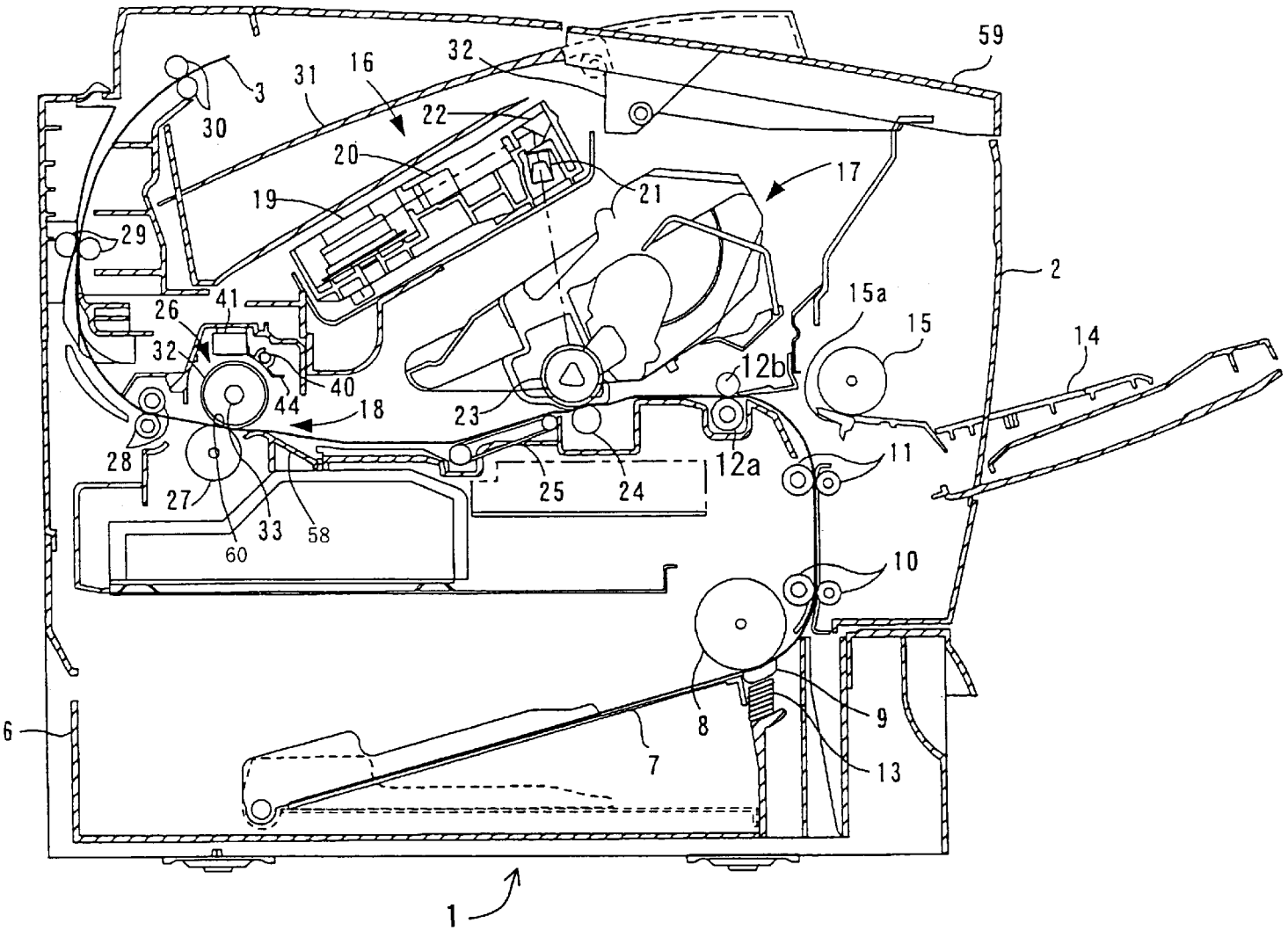
FIG. 1 is a cross-sectional view showing the inner structure of the laser printer.

FIG. 1 is a cross sectional view of the main portions of a laser printer 1.

A paper supply tray 6 that is detachable from a casing 2 is accommodated in the bottom portion of the casing 2. A pressure plate 7 for supporting papers 3 accommodated in the paper supply tray 6 and pressing the papers 3 upward is arranged in the paper supply tray 6. A paper supply roller 8 and a paper supply pad 9 are arranged on the upper side of one end of the paper supply tray 6. Feeding rollers 11 are arranged in the paper feed path downstream of the paper supply roller 8. Resist rollers 12*a*, 12*b* are arranged on the paper feed path downstream, in the paper feed direction, of the feeding rollers 11.

The papers 3 are piled to be accommodated on the pressure plate 7. The pressure plate 7 is supported reciprocatingly at its end away from the paper supply roller 8 and the end close to the paper supply roller 8 can move up and down. A spring (not shown) is arranged on the rear, or bottom, side of the pressure plate 7 to urge the pressure plate 7 upwardly. As the amount of the papers 3 on the pressure plate 7 is increased, the pressure plate 7 moves downward against the urging force of the spring in a condition that the end of the pressure plate 7 away from the paper supply roller 8 is fixed.

The paper supply roller 8 and the paper supply pad 9 are arranged so as to face with each other and the paper supply pad 9 is pressured toward the paper supply roller 8 by a spring 13 that is arranged on the under side of the paper supply pad 9.

The top paper of the piled papers 3 on the pressure plate 7 is pressured toward the paper supply roller 8 by the spring (not shown) from the rear side of the pressure plate so that a paper 3 is held between the paper supply roller 8 and the paper supply pad 9 and the papers 3 are thus transferred one by one by the rotation of the paper supply roller 8.

Paper powder removing rollers 10 are arranged on the paper feeding downstream side of the paper supply roller 8. When the paper 3 fed by the paper supply roller 8 contacts the paper powder removing rollers 10, a part of the paper powder on the surface of the paper 3 is removed.

After the paper powder is removed by the paper powder removing rollers 10, the paper 3 is fed to the resist rollers 12*a*, 12*b* by the feeding rollers 11. The resist rollers 12*a*, 12*b* comprise a driving roller 12*a* arranged on the casing 2 and a driven roller 12*b*, arranged on a process cartridge 17, which is rotated by the rotation of the driving roller 12*a*. The surfaces of the driving roller 12*a* and the driven roller 12*b* are in contact with each other and the paper 3, fed by the feeding rollers 11, is held by the driving roller 12*a* and the driven roller 12*b* to be fed downstream.

The driving roller 12*a* is controlled so that the driving roller 12*a* is not driven until the paper 3 contacts the driving roller 12*a*. When the paper 3 contacts the driving roller 12*a*, the paper 3 stops and the position of the paper 3 is corrected, the driving roller 12*a* rotates and the paper 3 is fed downstream.

A manual paper tray 14, for supplying manually fed paper and a manual feeding roller 15 for supplying the papers 3 placed on the manual paper tray 14 are arranged on the front side of the casing 2. A separation pad 15*a* is arranged facing the manual feeding roller 15. The separation pad 15*a* is pressured toward the manual feeding roller 15 by a spring (not shown) arranged on the rear, or lower, side of the separation pad 15*a*. The papers 3 placed on the manual paper tray 14 is held between the manual feeding roller 15 and the separation pad 15*a* by the rotation of the manual feeding roller 15 and the papers 3 are fed to the feeding roller 11 one by one.

A scanner unit 16, a process cartridge 17 and a fixing device 18 are provided in the casing 2.

The scanner unit 16 is arranged on the upper portion of the casing 2 and has a laser emission member (not shown), a polygon mirror 19 that is driven to be rotated, lenses 20, 21 and a reflection mirror 22. The laser beam emitted from the laser emission member is modulated based on the predetermined image data. The laser beam is passed or reflected via the polygon mirror 19, the lens 20, the reflection mirror 22 and the lens 21, as shown by the dashed line in FIG. 1, and the emitted laser beam scans on the surface of a photosensitive drum 23 with high speed.

The process cartridge 17 is detachably arranged in the lower side of the scanner unit 16 from the casing 2. The process cartridge 17 has the photosensitive drum 23, a scorotron-type charger, a developing roller and a toner container.

The toner container is filled with positive charged non-magnetic one component polymerized toner. The surface of the developing roller bears toner in a thin layer of a certain thickness.

The photosensitive drum 23 is arranged rotatably facing the developing roller. The positively charged photosensitive layer of polycarbonate is coated on the surface of cylindrical aluminum drum that is electrically earthed to obtain the photosensitive drum 23.

The surface of the photosensitive drum 23 is positively charged uniformly by the charger. When the laser beam from the scanner unit 16 is irradiated to the surface of the photosensitive drum 23, an electric charge is removed and the surface electric potential of the irradiated portion is decreased. The surface of the photosensitive drum 23 is divided into a high electric potential portion (non-exposed portion) and a low electric potential portion (exposed portion) according to the image that is to be formed, and an electrostatic latent image is formed.

The positive charged toner borne on the developing roller is supplied to the exposed portion where the surface potential is decreased when facing the photosensitive drum 23. Thus, the electrostatic latent image becomes visible.

The transfer roller 24 is arranged at the lower side of the photosensitive drum 23 so as to face the photosensitive drum 23. The transfer roller 24 is supported rotatably by the casing 2. The transfer roller 24 is obtained by covering the metal roller shaft with the conductive rubber material. An electric power source (not shown) is connected to the roller shaft and a predetermined transfer bias is applied to the roller shaft when the toner is transferred to the paper 3.

The visible image formed with toner on the photosensitive drum 23 is transferred to the paper 3 when the paper 3 passes between the photosensitive drum 23 and the transfer roller 24. The paper 3, to which the visible image is transferred, is fed to the thermal fixing device 18 via the feeding belt 25.

In the case of color printing, a middle transfer belt contacts the photosensitive drum provided for each color and the toner of each color is transferred onto the middle transfer belt. Moreover, the middle transfer belt and the transfer roller contact and the toner of each color is transferred to the paper that passes therebetween.

Figure 2:
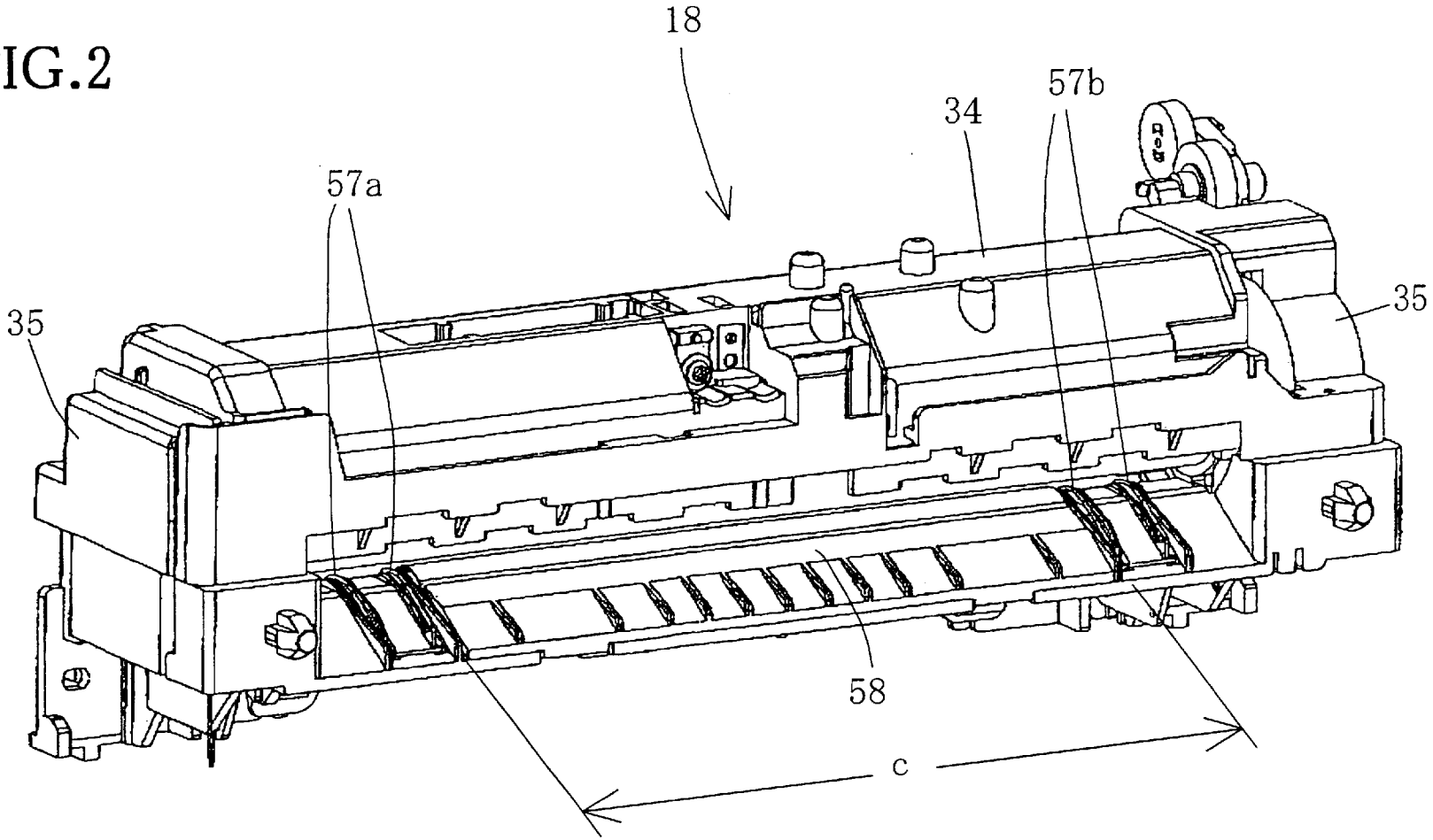
FIG. 2 is a perspective view of the thermal fixing device.

As shown in FIG. 1, the thermal fixing device 18 is arranged downstream of the process cartridge 17. As shown in FIGS. 1 through 3, the thermal fixing device 18 has a casing member 34 fixed at the casing 2. A heat roller 26, a pressure roller 27 and a guide plate 58 for guiding the paper 3 to a nip portion 60 formed between the heat roller 26 and the pressure roller 27 are arranged in the casing member 34. The guide plate 58 is formed of a conductive material.

The casing member 34 is formed by an insulation material in a box shape whose lower side is open. Holder members 35 are arranged on the two ends of the casing portion 34, in its longitudinal direction, for supporting the heat roller 26 and the pressure roller 27 rotatably. A temperature fuse 40 and thermostat 41 are provided in a predetermined position in the casing member 34. Feeding rollers 28 for feeding the paper 3 that passes between the heat roller 26 and the pressure roller 27 are supported rotatably downstream of the heat roller 26 and the pressure roller 27 in the casing member 34.

The heat roller 26 comprises an aluminum cylinder 32 coated with silicone rubber having a halogen lamp 33 therein. The heat generated from the halogen lamp 33 is transferred to the paper 3 via the aluminum cylinder 32. The pressure roller 27 is made from silicone rubber and has cushioning. Because the heat roller 26 and the pressure roller 27 use silicone rubber, the paper 3 easily comes off the heat roller 26 and the pressure roller 27.

The heat roller 26 and the pressure roller 27 contact in the up-down direction and the nip portion 60 is formed therebetween. The paper 3 is fed when held by the nip portion 60. The toner on the paper 3 is melted by the heat from the heat roller 26 and fixed onto the surface of the paper 3 by the pressure force by the heat roller 26 and the pressure roller 27 when the paper 3 passes through the nip portion 60.

Instead of using the heat roller 26 or the pressure roller 27, a fixing device using an endless belt can be used. Such an example will be explained later.

The paper 3, with the toner fixed by the thermal fixing device 18, is fed to discharge rollers 30 by the feeding rollers 28, 29 downstream of the thermal fixing device 18, as shown in FIG. 1. The paper 3 is then fed to the discharge rollers 30 and discharged onto a discharge tray 31.

Figure 3A:
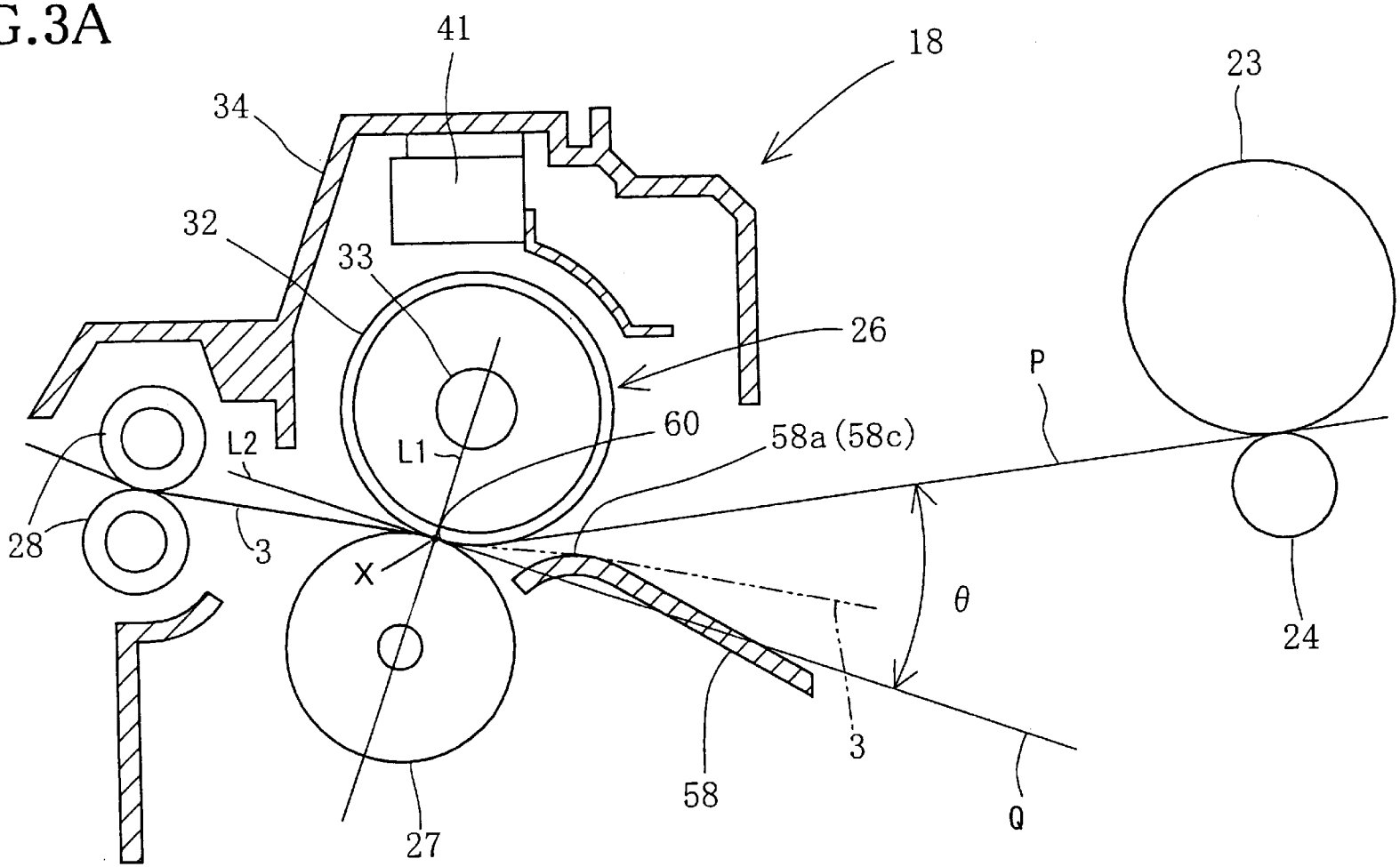
FIGS. 3A and 3B are cross sectional views of the thermal fixing device.

A ridge portion 58*a*, which projects to the paper side, is formed on the upper surface of the guide plate 58, as shown in FIG. 3A. The guide plate 58 has a top portion 58*c* that is the highest position of the ridge portion 58*a* in the vertical direction.

Suppose that there is a first surface P extending to contact the pressure roller side surface of the heat roller 26 and the transfer roller side surface of the photosensitive drum 23. Also suppose that there is a second surface Q extending to include the tangent common to the heat roller 26 and the pressure roller 27.

The guide plate 58 is positioned so that the top portion 58*c* of the guide plate 58 is positioned between the first surface P and the second surface Q.

The paper 3 enters the nip portion 60 guided by the top portion 58*c*. The feeding speed of the paper 3 by the fixing device 18 is set a little less than the feeding speed of the paper 3 by the photosensitive drum 23 and the transfer roller 24. If the feeding speed by the fixing device 18 is set faster, the paper 3 is pulled by the nip portion 60 and problems will occur in the transfer of the toner from the photosensitive drum 23 to the paper 3.

The paper 3 passes between the photosensitive drum 23 and the transfer roller 24 so that the toner is transferred to the paper 3, the front end of the paper 3 moves along the surface of the guide plate 58 and enters the nip portion 60 via the top portion 58*c*. Because the top portion 58*c* is located between the first surface P and the second surface Q, the paper 3 is fed via the top portion 58*c* close to the heat roller 26 and held in that condition. Because the paper 3 is fed while being pressed to the heat roller 26 side, the toner 3 on the paper 3 is preheated by the heat of the heat roller 26.

When the rear end of the paper 3 is released from the photosensitive drum 23 and the transfer roller 24, the paper 3 is supported by the top portion 58*c* and the rear end of the paper 3 falls off naturally. Because the rear end of the paper 3 falls off quietly without contacting the cartridge 17 or other portions, the toner on the paper 3 is not scattered and the image quality can be maintained.

Because the toner is preheated before the paper 3 enters the nip portion 60, scattering of the toner around the nip portion 60 is prevented and the image quality becomes stable.

Figure 6:
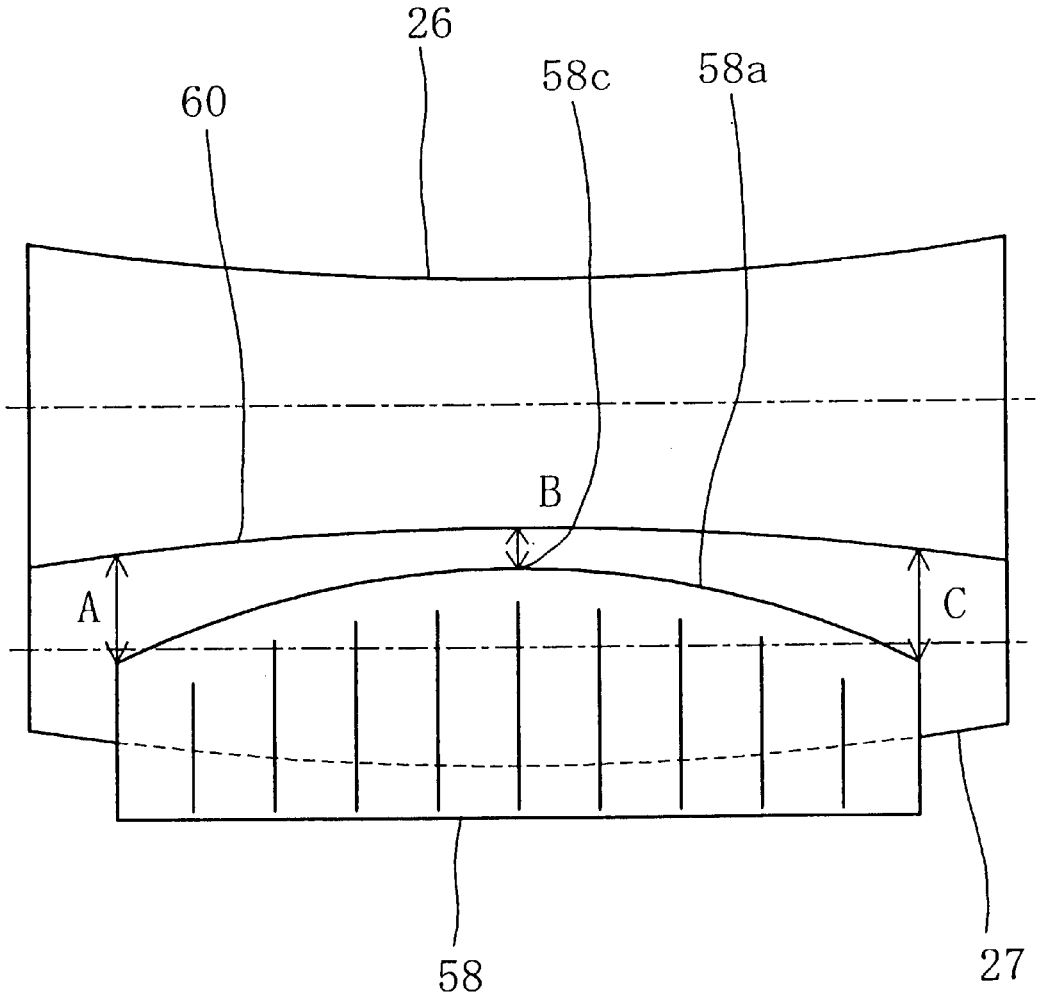
FIG. 6 is a view of the heat roller, the pressure roller and the guide plate structuring the thermal fixing device seen from the upstream side.
Figure 7:
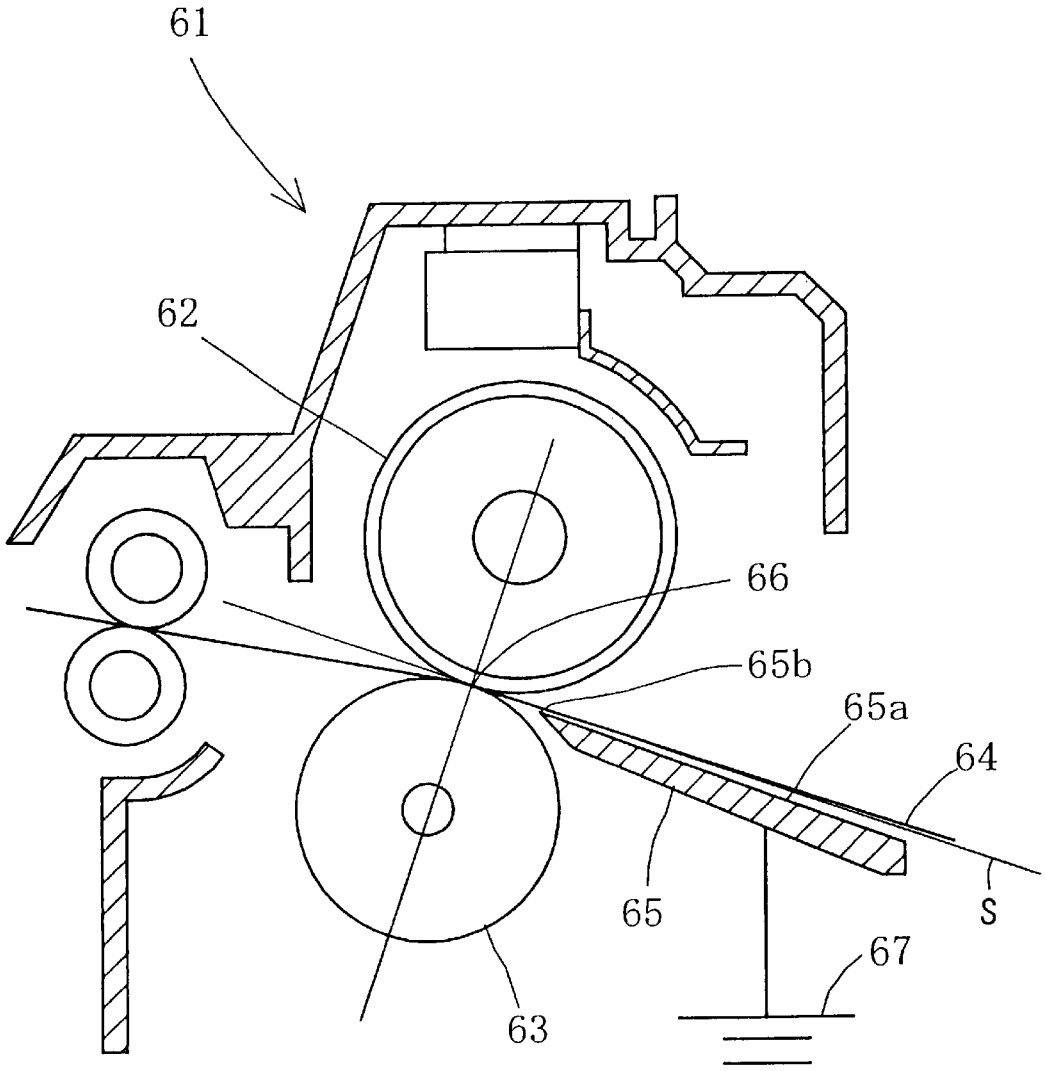
FIG.7 RELATED ART
FIG. 7 is a cross sectional view of the thermal fixing device of the related art.
Figure 8:
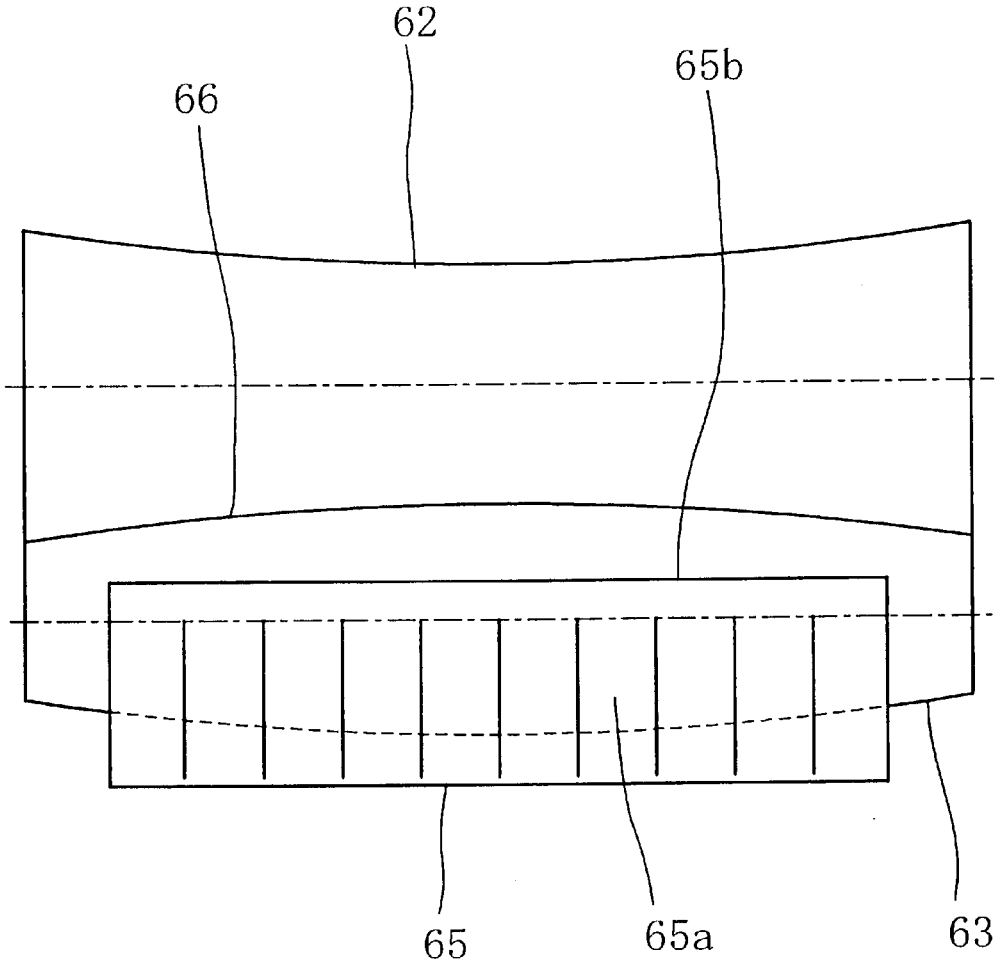
FIG.8 RELATED ART
FIG. 8 is a view of the heat roller, the pressure roller and the guide plate structuring the thermal fixing device of the related art seen from the upstream side.

When the guide plate 58 is curved, relative to the vertical direction in the paper 3 feeding direction, as shown in FIG. 6, the highest position of the ridge portion 58*a* forming the ridge line in the vertical direction is the top portion 58*c*. When the guide plate 58 is not curved relative to the vertical direction in the paper 3 feeding direction, the height is same in any position of the ridge portion 58*a* in the vertical direction and the top portion 58*c* is any position on the ridge portion 58*a*.

The common tangent included in the second surface Q is determined as follows. The heat roller 26 and the pressure roller 27 contact with a surface of a predetermined width at the nip portion 60. Suppose that there is a center line parallel to the shafts of the heat roller 26 and the pressure roller 27 on the contact surface of the heat roller 26 and the pressure roller 27. In the cross sectional view of FIG. 3A, the center line is a dot X on the contact surface of the heat roller 26 and the pressure roller 27.

Moreover, in the cross sectional view, suppose that there is a circle having a shaft center of the heat roller 26 as a center and a first line that links the shaft center and the above-described center line as a radius. And, suppose that there is a circle having a shaft center of the pressure roller 27 as a center and a second line that links the shaft center and the above-described center line as a radius.

The extension of the first line will precisely overlap the second line, which is shown as line L1 in FIG. 3A.

The two circles contact at the dot X of the above-described center line. The tangents of the two circles become the same line L2 in FIG. 3A, which is perpendicular to both the center line and the line L1. The second surface Q is defined as a surface including the common tangent, which is the line L2.

As shown in FIG. 6, the heat roller 26 is formed in an arch crown shape and the pressure roller 27 is formed in a reversed arch crown shape. The common tangent included in the second surface Q can be: 1) the tangent at both ends of the heat roller 26 and the pressure roller 27 that has the smallest arch crown, or 2) the tangent at the center portion of the heat roller 26 and the pressure roller 27 that has the largest arch crown.

The second surface Q is determined preferably to include the tangent at the center portion of the heat roller 26 and the pressure roller 27 in order to enter the paper 3 into the nip portion 60 as smoothly as possible by placing the top portion 58*c* closer to the nip portion 60.

The ridge portion 58*a* on the upper surface of the guide plate 58 can be sharpened like a mountain shape, however, the ridge portion 58*a* is preferably shaped in a curved surface projecting to the paper side as shown in FIG. 3A. Because the paper 3 proceeds while contacting the curved surface formed by the ridge portion 58*a*, creasing is prevented and there are no rub marks, or smears, resulting on the paper 3 surface. Further, the generation of paper powder can be prevented.

The guide plate 58 is formed of a conductive material, such as conductive resin or metal. Preferably, the guide plate 58 is formed of a metal plate, arranged on the insulating casing 34, and maintained in a float condition electrically, that is, the potential of the guide plate 58 is not stable.

When the guide plate 58 is formed of a metal plate, static electricity is hardly generated between the guide plate 58 and the paper 3. Thus, the electric charge for adhering the toner to the surface of the paper 3 that contacts the guide plate 58 is stable.

If the guide plate 58 is grounded, electric charge on the paper 3 is removed and the toner may be scattered. On the other hand, when the guide plate 58 is formed of an insulating material, static electricity will be generated by the friction between the paper 3 and the guide plate 58 and the toner will be scattered.

Because the guide plate 58, made of the conductive material, is maintained in the float condition, the electric charge for adhering the toner to the surface of the paper 3 that contacts the guide plate 58 can be maintained and scattering of the toner is prevented.

Figure 3B:
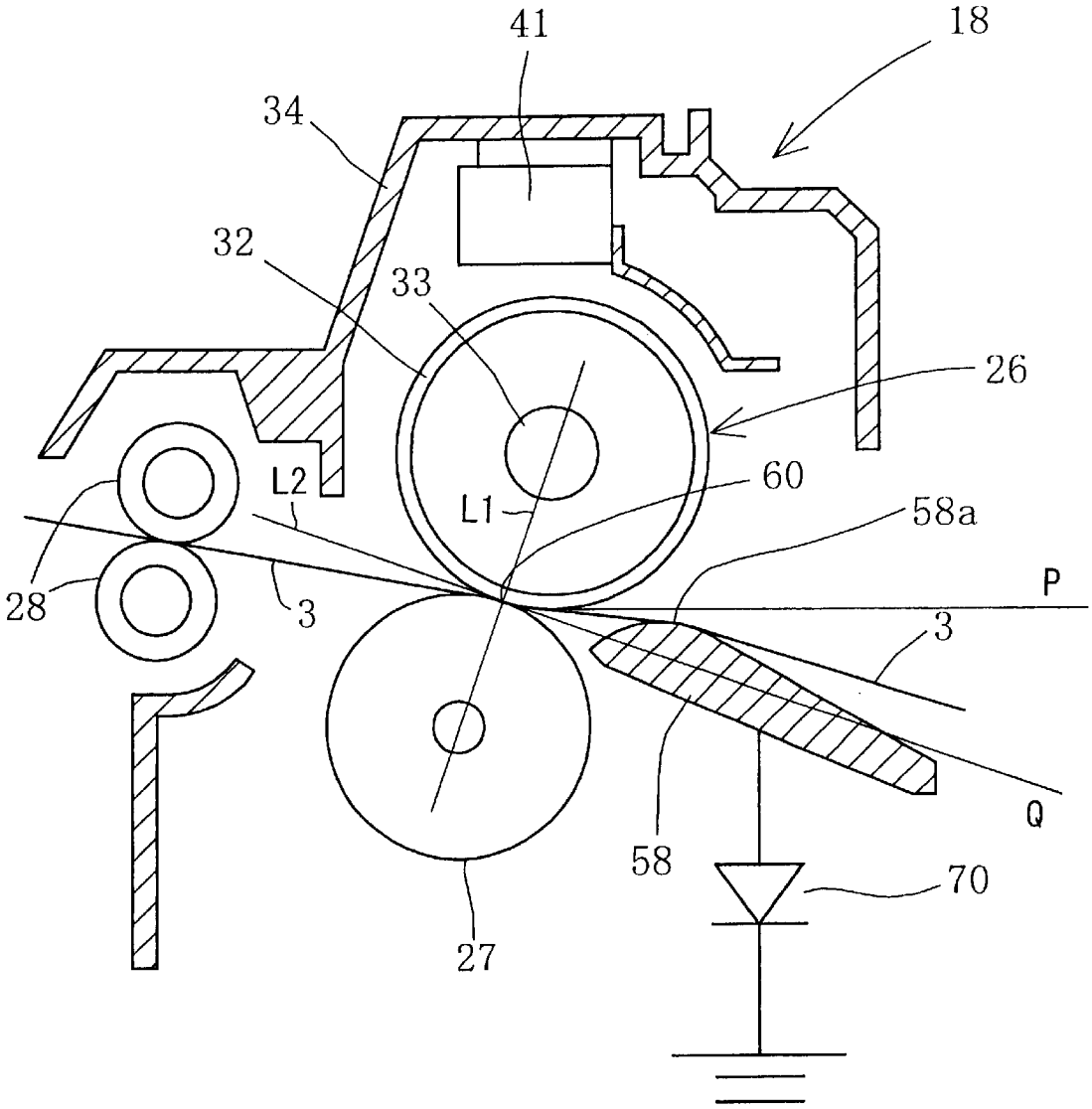

As shown in FIG. 3B, the guide plate 58 can be grounded via a unidirectional rectifying element. The rectifying element is connected to the guide plate 58 so that a negative voltage is applied to the guide plate 58. For example, a Zener diode 70 is used for the rectifying element. The potential of the paper 3 can be controlled easily by the Zener diode 70 and scattering of the toner by the static electricity can be prevented certainly.

Because the toner used in the preferred embodiment is positively charged, as described above, the surface of the paper 3 that contacts the guide plate 58 is negatively charged. Therefore, the anode of the Zener diode 70 is connected to the guide plate 58 as shown in FIG. 3B.

If the negative charged toner is used, the cathode of the Zener diode 70 should be connected to the guide plate 58 so that the surface of the paper 3 that contacts the guide plate 58 is positively charged.

The width of the guide plate 58, that is, the width in the direction perpendicular to the paper feeding direction can be more than or equal to the width of the paper 3. Preferably, the left-right width c of the guide plate 58 is formed smaller than the width of the paper 3, as shown in FIG. 2. As an example, suppose that a B5-size paper that is relatively small in the normally used paper size is fed in its longitudinal direction, and the width of the guide plate 58 is set smaller than the width of the B5-size paper.

Because both lateral sides of the paper 3 do not contact the guide plate 58, the toner on the paper 3 is not adhered onto the guide plate 58 and scattering of the toner can be prevented.

Conductive linear members 57*a*, 57*b* (FIG. 2) are arranged on the lateral sides of the guide plate 58 so as to be guided by the guide surface of the guide plate 58. The linear members 57*a*, 57*b* are maintained in the float condition the same as the guide plate 58 or earthed via the Zener diode 70.

The lateral sides of the paper 3 go over the lateral sides of the guide plate 58 when the paper 3 passes along the guide plate 58, a portion of the paper 3 that goes over the guide plate 58 is supported by the linear members 57*a*, 57*b* so that the paper 3 can be fed stably.

Two linear members 57*a*, 57*b* are arranged on each lateral side of the guide plate 58 respectively. When the B5-size paper is fed, one side of the paper passes between the two linear members 57*a*, 57*a* and the another side of the paper passes between the two linear members 57*b*, 57*b*. When the A4-size paper is fed, both lateral sides of the paper pass outside the outer linear members 57*a*, 57*b*. The linear members 57*a*, 57*b* do not influence the electric charge of the paper 3.

Figure 4:
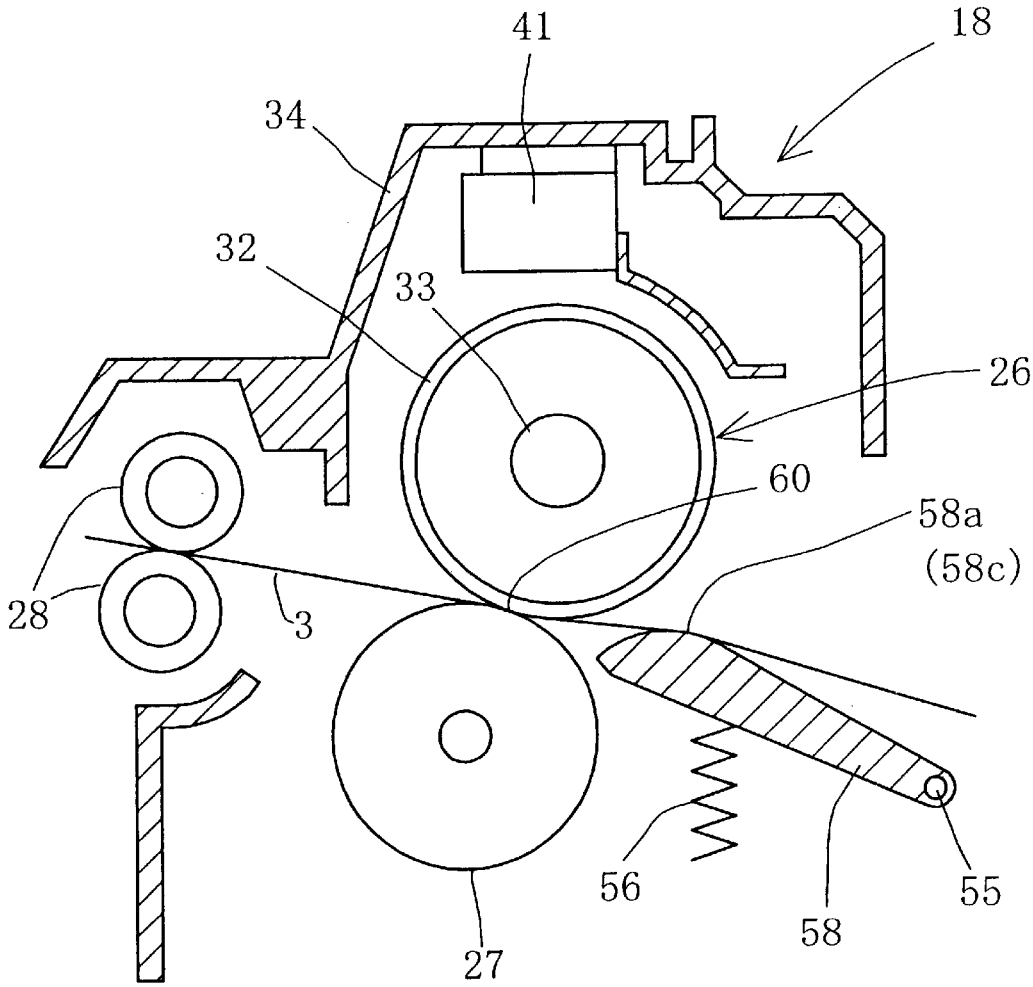
FIG. 4 is a cross sectional view of the thermal fixing device of another embodiment.

The guide plate 58 of another embodiment is shown in FIG. 4. The guide plate 58 is urged upward by a spring 56 and is rotatable around a supporting shaft 55. The supporting shaft 55 is arranged parallel to the rotation shafts of the heat roller 26 and the pressure roller 27. The guide plate 58 is formed so that its upper side is curved to project upwardly and its upper surface is close to the surface of the heat roller 26. The guide plate 58 changes its position freely according to the rigidity and the movement change of the paper 3, and holds the paper 3 so as to be close to the heat roller 26. Because the paper 3 is preheated by the heat roller 26 before entering the nip portion 60, scattering of the toner can be prevented.

An element made of elastic material, such as rubber, can be used instead of the spring 56. In such a case, the supporting shaft 55 is not necessarily used, however, the movement of the guide plate 58 is stabilized by using the supporting shaft 55.

The elasticity of the guide plate 58 itself can be used instead of the spring 56. The guide plate 58 can be formed of an elastic material and the paper 3 can be maintained close to the heat roller 26 by its elastic change. Because the guide plate 58 can be used as the urging means, the structure around the guide plate 58 is simplified.

The linear members 57*a*, 57*b* can be structured so as to urge the paper 3 upward.

Figure 5:
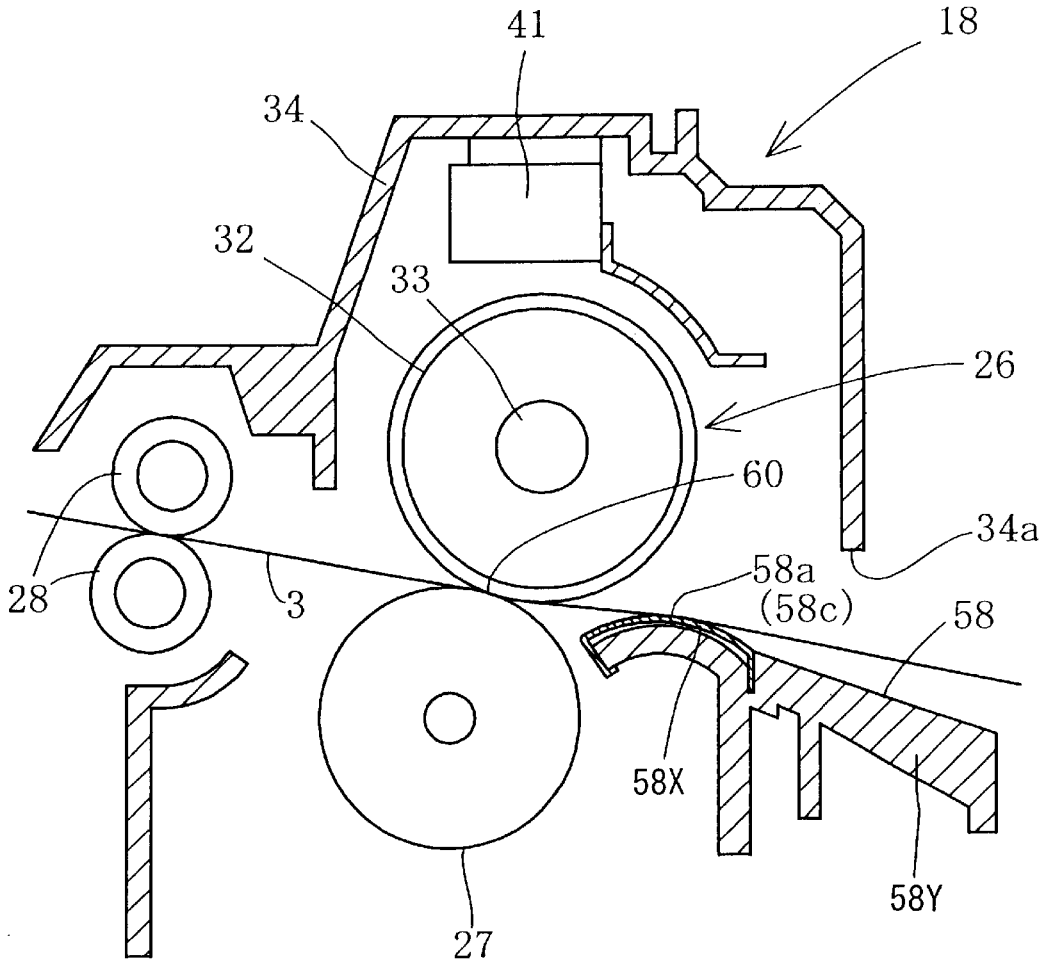
FIG. 5 is a cross sectional view of the thermal fixing device of another embodiment.

The guide plate 58 of another preferred embodiment is shown in FIG. 5. The guide plate 58 comprises a guide member 58X and a base member 58Y. The guide member 58X is formed of a conductive material, such as a metal plate, and the base member 58Y is formed of an insulating material, such as a resin.

The base member 58Y is formed of insulating resin integrally with the casing portion 34. The base portion 58Y is projected close to the nip portion 60 and supports the guide member 58X on its projected portion. Because the base member 58Y is formed of the resin, the base member 58Y does not reserve heat and does not become hot when heated by the heat roller 26.

The guide member 58X is formed by drawing a thin metal plate and arranging it on the upper surface of the base member 58Y having a space therebetween. The elasticity of the guide member 58X changes its shape freely according to the rigidity and the movement change of the paper 3. Further, the guide member 58X holds the paper 3 so as to be close to the heat roller 26. Because the paper 3 is certainly guided to the nip portion 60, the paper 3 is preheated by the heat roller 26 before entering the nip portion 60 and scattering of the toner can be prevented.

The ridge portion 58*a*, projecting to the paper 3 side and having a curved surface, is formed on the guide member 58X. Because the paper 3 contacts the curved surface of the ridge portion 58*a*, rub marks or creases are not produced on the paper 3 and paper powder is not generated.

Because the guide member 58X is formed of metal, the guide member 58X is heated by the heat from the heat roller 26 and becomes hot. The guide member 58X is arranged close to the nip portion 60 of heat roller 26 and pressure roller 27. The rear bottom end 34*a* of the casing member 34 extends lower than the center shaft of the heat roller 26 and is placed above the base member 58Y. Therefore, when a paper becomes jammed in the thermal fixing device 18, the operator's hand does not touch the guide member 58X and the operator is not burned when solving the paper jamming problem.

The guide member 58X contacts the paper 3 held by the nip portion 60 and is formed of metal. Therefore, the guide member 58X hardly generates static electricity by friction with the paper 3. The guide member 58X is maintained in the float condition electrically above the base member 58Y. Because the electric charge of the surface of the paper 3 that contacts the guide plate 58 is reserved, the toner is adhered to the paper 3 by the electric charge and scattering of the toner is prevented.

The base member 58Y can be formed of conductive resin. In this case, when the base member 58Y is made in the float condition electrically or the base member 58Y is earthed via the Zener diode, the same effects as described above can be obtained.

As shown in FIG. 6, the ridge portion 58*a* of the guide plate 58 is formed to be curved in the vertical direction and the curvature is the same or larger than that of the reversed arch crown and the arch crown formed on the heat roller 26 and the pressure roller 27.

In FIG. 6, the heat roller 26 is formed in the reversed arch crown shape and the pressure roller 27 is formed in the arch crown shape. However, the heat roller 26 can be formed in the arch crown shape and the pressure roller 27 can be formed in the reversed arch crown shape.

The guide plate 58 is formed by curving a metal plate in the vertical direction. The curvature of the ridge portion 58*a* can be same as that of the reversed arch crown or the arch crown. The curvature of the ridge portion 58*a* is preferably set larger than that of the reversed arch crown or the arch crown.

As shown in FIG. 6, spaces A, B and C are formed between the guide plate 58 and the nip portion 60 and the relationship in size of the spaces A, B and C is $A=C \geqq B$.

The paper 3 is fed in a condition that the front, or lead, end of the paper 3, that is guided by the guide plate 58, is curved in the vertical direction by the curvature of the ridge portion 58*a*. First, the center portion of the front end of the paper 3 is nipped by the center portion of the nip portion 60 and the lateral ends of the paper 3 are nipped. The width of the paper 3 is stretched and passes the nip portion 60.

In the above-described embodiments, the thermal fixing device 18, where the paper 3 is fed between the heat roller 26 and the pressure roller 27 so that the toner is fixed onto the paper 3 by heat and pressure, is explained. However, a similar guide plate can be applied to a thermal fixing device of another type.

Figure 9:
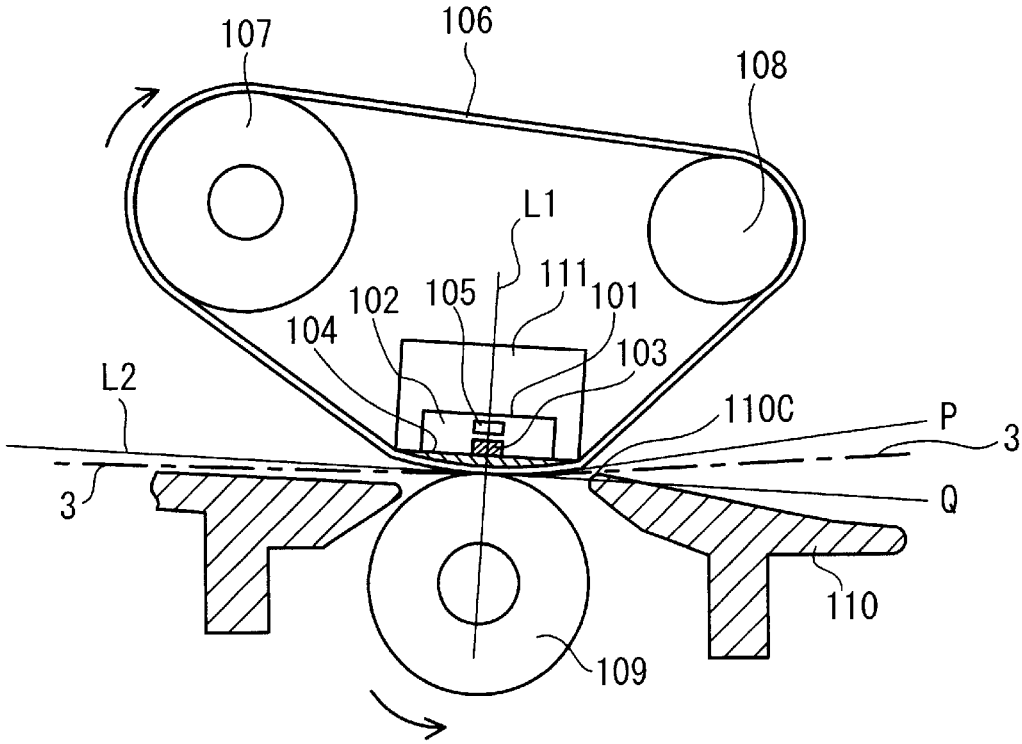
FIG. 9 is a cross sectional view of the thermal fixing device of an additional embodiment.

A thermal fixing device of another type is shown in FIG. 9. A resistance sheet 103, formed of a resistance material, is adhered, by an adhesive, onto a heat resisting elastic plate 102 that is formed of silicone rubber or fluoro rubber. A coating layer 104 is provided on the resistance sheet 103 for good sliding thereby creating a heat body 101.

An endless film 106 of high thermal conductivity contacts the surface of the heat body 101. The film 106 moves in a predetermined paper feeding direction along the surfaces of guide rollers 107, 108 and the heat body 101. The film 106 is held between the heat body 101 and a pressure roller 109 that is arranged to oppose to the heat body 101.

The paper 3 enters a nip between the film 106 and the pressure roller 109. The lateral ends of the resistance sheet 103, in its longitudinal direction, are connected to a power source (not shown) and the resistance sheet 103 is energized at the time the paper 3 is fed.

The heat body 101 generates heat by the energization of the resistance sheet 103. The heat is transferred to the paper 3 via the film 106 for fixing the toner.

A guide plate 110 for guiding the paper 3 between the film 106 and the pressure roller 109 is arranged so that its top portion is placed between the first surface P and the second surface Q. The first surface P is defined as a surface extending from contacting a pressure roller side surface of the film 106 and contact a transfer roller side of the photosensitive drum 23 (not shown in FIG. 9).

The second surface Q is defined as a surface obtained as follows. A line L1 that links the curvature center of the film 106 and the curvature center of the pressure roller 109 is obtained in a portion where the film 106 and the pressure roller 109 contact. The second surface Q is defined as a surface that includes a line L2 that is perpendicular to the line L1 at the above-described contact portion on the line L1.

The same effects can be obtained by this structure as with those previously described.

The guide plate 110 may be maintained in the float condition electrically or earthed by a Zener diode.

The thermal fixing device applied to the laser printer is explained in the above-described embodiments, however, the thermal fixing device can be arranged in other devices, such as a facsimile device or a copying device.

A corotron-type transferring device can be used instead of the transfer roller.

The ridge portion 58*a* is formed in a middle of the upper surface of the guide plate 58 in FIGS. 3A, 3B and 4, however, the ridge portion 58*a* can be formed on the front end of the guide plate 58.

The Zener diode 70 can be connected to the guide member 58X of the guide plate 58 in the embodiment of FIG. 5.

The present examples and embodiments are to be considered as illustrative and not restrictive, and the invention is not to be limited to the details given herein, but may be modified within the scope and equivalents of the appended claims.

What is claimed is:

1. A thermal fixing device, comprising:

a heater;

a pressure member in contact with the heater;

a feeder that feeds a medium; and a guide member that guides the medium fed by the feeder to a contact portion where the heater and the pressure member contact, wherein the guide member is arranged so as to guide the medium while in contact with the medium, the contact positioned between a first surface and a second surface, the first surface is a surface including a line that links the contact portion and the feeder and the second surface is a surface including a second line that is perpendicular to a first line that links a curvature center in the contact portion of the heater and a curvature center in the contact portion of the pressure member at a point where the first line crosses the contact portion.

2. The thermal fixing device according to claim 1, further comprising an urging member formed of an elastic body that urges the guide member toward the heater.

3. The thermal fixing device according to claim 2, wherein the urging member is arranged so that the guide member rotates around a shaft that is parallel to the contact portion.

4. The thermal fixing device according to claim 1, wherein the guide member is formed of an elastic body and urged toward the heater.

5. The thermal fixing device according to claim 1, wherein the heater is a heat roller that is heated by a heat generating source and the pressure member is an elastic pressure roller, at least one of the heat roller and the pressure roller being formed in an arch crown shape or a reversed arch crown shape.

6. The thermal fixing device according to claim 5, wherein a width of the guide member is smaller than a width of the medium that is fed.

7. The thermal fixing device according to claim 6, wherein a curved surface is formed on the guide member and the medium is fed in contact with the curved surface.

8. The thermal fixing device according to claim 7, wherein a curvature of the curved surface of the guide member is larger than a curvature of the arch crown shape of the one of the heat roller and the pressure roller.

9. The thermal fixing device according to claim 5, wherein one of the heat roller and the pressure roller is formed in the arch crown shape and the other one of the heat roller and the pressure roller is formed in the reversed arch crown shape.

10. The thermal fixing device according to claim 1, wherein the guide member is structured by arranging a metal guide portion on a base made of resin and the medium is fed in contact with the guide portion.

11. The thermal fixing device according to claim 1, wherein a conductive member is arranged at each end of the guide member and on a surface of the guide member and each side of the medium contacts the conductive member at corresponding end of the guide member when the medium is fed.

12. The thermal fixing device according to claim 1, wherein the guide member is conductive and is maintained in a float condition electrically.

13. The thermal fixing device according to claim 1, wherein the guide member is conductive and is earthed electrically via a rectifying member.

14. The thermal fixing device according to claim 13, wherein the rectifying member is a Zener diode and applies a voltage to the guide member, the voltage having an opposite polarity to a potential held by the medium.

15. The thermal fixing device according to claim 1, wherein the heater comprises a heat generating source and an endless belt is formed of a film and arranged close to the heat generating source and the pressure member is a roller.

16. The thermal fixing device according to claim 1, wherein the guide member is conductive and electrically earthed via a rectifying member.

17. The thermal fixing device according to claim 16, wherein the rectifying member is a Zener diode and applies a voltage to the guide member, the voltage having an opposite polarity to a potential held by the medium.

18. The thermal fixing device according to claim 1, wherein where the pressure member and the heater contact defines a nip portion between the heater and the pressure member; and the guide member comprises a guide portion so that the medium is guided toward the nip portion in a manner such that the medium is close to the heater.

19. The thermal fixing device according to claim 18, wherein the guide member is conductive and is maintained in a float condition electrically.

20. A thermal fixing device, comprising:

a heater;

a pressure member in contact with the heater; and a guide member that guides a medium to a contact portion where the heater and the pressure member contact, wherein the guide member is conductive and is maintained in a float condition electrically.

* * * * *